United States Patent [19]

Ritter et al.

[11] 3,986,325

[45] Oct. 19, 1976

[54] AUXILIARY PNEUMATIC DEVICE

[75] Inventors: Helmut Ritter; Emil Jung, both of Wattwil, Switzerland

[73] Assignee: Heberlein Maschinenfabrik AG, Wattwil, Switzerland

[22] Filed: Oct. 22, 1974

[21] Appl. No.: 516,960

[30] Foreign Application Priority Data

Oct. 29, 1973 Switzerland ..... 15153/73
May 8, 1974 Switzerland ..... 6241/74

[52] U.S. Cl. ..... 57/34.5; 57/56; 302/1

[51] Int. Cl.[2] ..... D01H 11/00; D02G 1/02

[58] Field of Search ..... 57/34.5, 34 HS, 34 B, 57/56; 226/7, 97; 242/35.5 R; 302/1

[56] References Cited

UNITED STATES PATENTS

| | | | |
|---|---|---|---|
| 2,799,356 | 7/1957 | Hewitt | 57/56 X |
| 2,908,029 | 10/1959 | Furst | 57/34.5 X |
| 2,946,174 | 7/1960 | Bahnson, Jr. | 57/56 |
| 3,018,503 | 1/1962 | Hijiya et al. | 57/56 X |
| 3,066,471 | 12/1962 | Scragg | 57/34.5 |
| 3,077,311 | 2/1963 | Furst | 242/35.5 R |
| 3,381,462 | 5/1968 | Parker et al. | 57/34.5 |
| 3,842,580 | 10/1974 | Franzen | 57/34.5 X |

*Primary Examiner*—John Petrakes
*Attorney, Agent, or Firm*—Fitzpatrick, Cella, Harper & Scinto

[57] ABSTRACT

Pneumatic yarn aspirating device includes at least one tube, a vacuum source connected to the tube, openings and filament aspirating elements spaced along the tube, and means for controlling the size of the openings.

16 Claims, 14 Drawing Figures

10
12
14
15
16
44
45
46
47
48
49
50
51
52
53
S
K

AUXILIARY PNEUMATIC DEVICE

This invention relates to an auxiliary pneumatic device, and more particularly to such a device which is useful for aspirating a running yarn during manipulations on a textile machine.

Auxiliary penumatic devices of the class described are used for threading or for exchanging full bobbins on high-speed textile machines, such as false-twist texturing machines for example, wherein the running yarn is aspirated as long as it is maintained in place in the auxiliary device.

Known auxiliary pneumatic devices for aspirating broken yarns are entirely unsuitable for this purpose. Thus, we contribute by the present invention a simple auxiliary pneumatic device which permits the aspiration of yarn during manipulations on textile machines in an economical manner. According to one aspect of the present invention, we provide at least one tube extending over the whole length of the machine, and a vacuum source connected to the tube for drawing air therethrough, the tube being formed at regular distances with openings and filament aspirating elements and with members for reducing the size of the suction openings. The device of the present invention makes it possible to introduce the yarn end to be aspirated while the opening has its full size and to aspirate it while the size of the suction opening is essentially reduced which necessitates far less suction power. The ratio between the unreduced suction opening and the reduced suction opening may amount to between 100:1 and 25:1, as explained more fully hereinafter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent construction as do not depart from the spirit and scope of the invention.

Specific embodiments of the invention have been chosen for purposes of illustration and description, and are shown in the accompanying drawings forming a part of the specification wherein.

Figure 1:
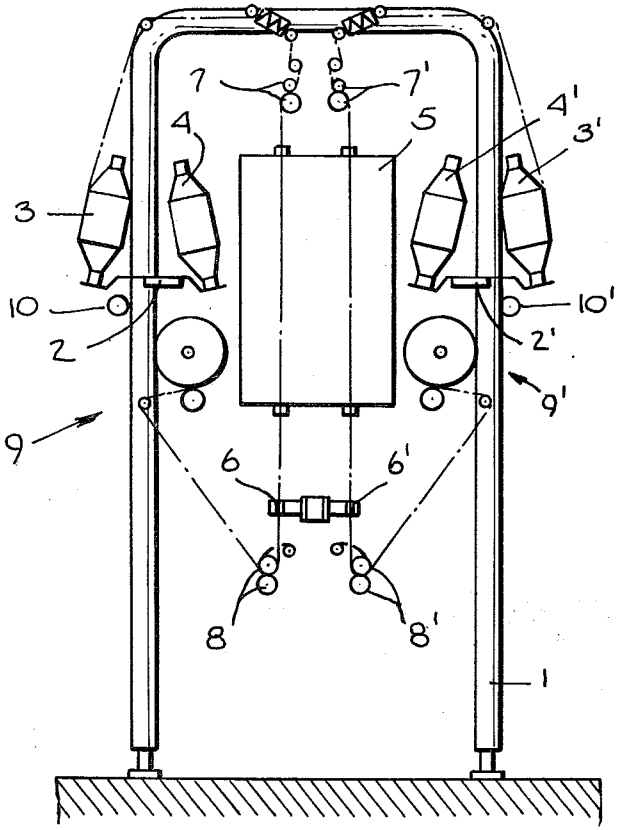
FIG. 1 is a cross-sectional view through a false-twist texturing machine equipped with the device of the present invention.

Referring now to the drawings, and particularly to FIG. 1, we illustrate a machine frame 1 of the texturing machine on which bobbin holders 2, 2', yarn delivery bobbins 3, 3', 4, 4', heating device 5, false-twist impartners 6, 6', delivery devices 7, 7', 8, 8', and wind-up devices 9, 9' are arranged. In the vicinity of the wind-up devices 9, 9', as shown in FIGS. 1 and 2, we provide tubes 10, 10' with the yarn suction elements 11 extending along the machine under the delivery bobbins.

Figure 2:
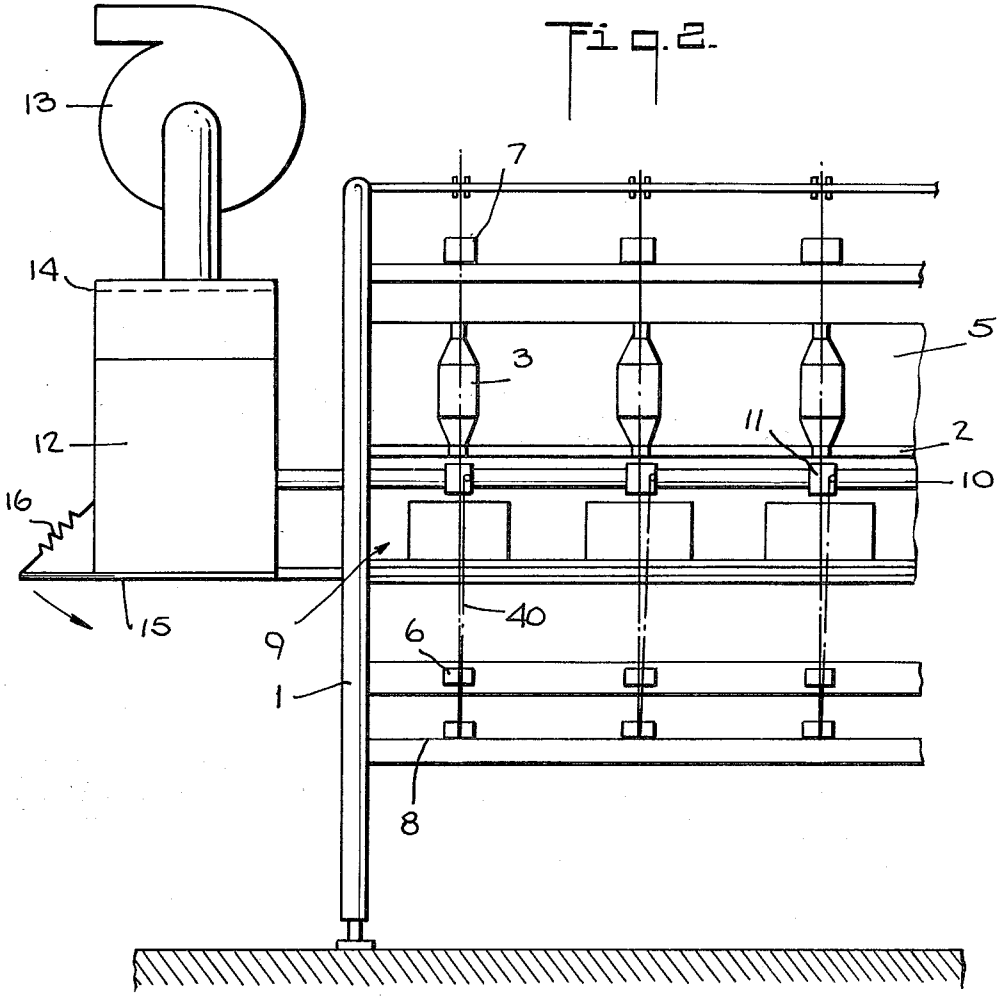
FIG. 2 is a front elevational view illustrating a part of the machine of FIG. 1.

As best shown in FIG. 2, we dispose a yarn suction element 11 on the tube 10 adjacent each yarn treatment post. The tube 10 terminates in a container 12 for lodging the aspirated yarns and this container is itself connected with a ventilator 13 which can be switched on and off as necessary. The container 12 comprises in its upper part a separator 14 which prevents aspirated yarn material from penetrating into the ventilator. On the bottom, the container 12 is provided with a door or cover 15 for emptying same, and which can be biased towards the container wall by means of a spring 16. The tube 10 may be formed of aluminum with a hard-anodized surface to assure, in the suction openings of the yarn suction elements 11, the necessary wear resistance with respect to the aspirated yarn 40.

Figure 4:
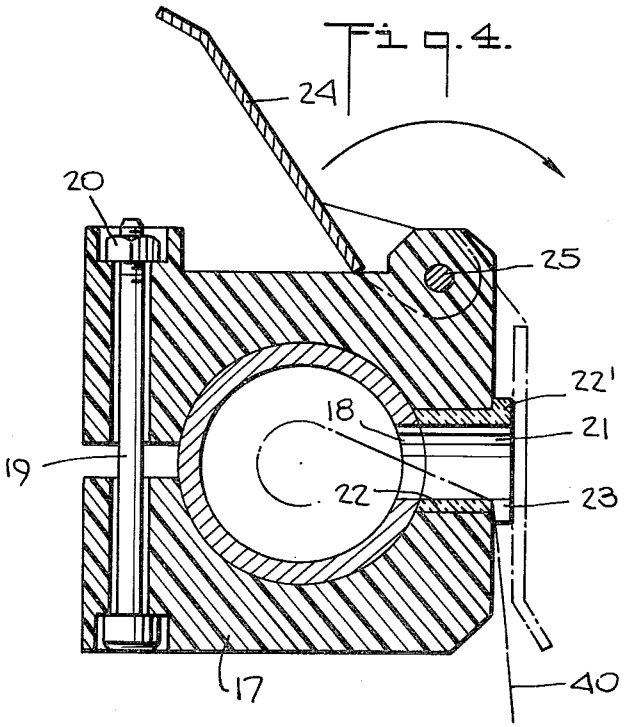
FIGS. 3 to 12 illustrate five examples of the yarn suction element together with the member for reducing the opening in front elevation and in cross-section, respectively.
Figure 3:
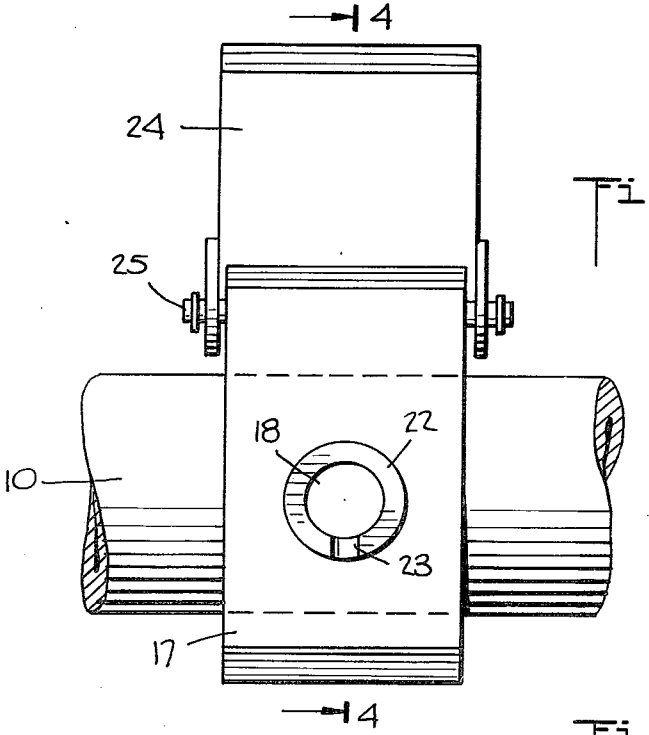

The embodiment of yarn suction element 11 shown in FIGS. 3 and 4 comprises a body 17, shiftable along the tube 10, and which is fixed above the circular opening 18 of tube 10 by means of clamping screw 19 and screwnut 20. As shown, the body 17 may be formed either of metal or of synthetic material and comprises a bore 21 in registry with the opening 18 in the tube 10, and having a tubular insert 22 of wear-resistant material, for example ceramic material. The insert 22 has a marginal part 22' extending beyond the body 17 and provided with a recess 23. The body 17 also comprises a pivotable cover 24 which is fixed on body 17 by means of hinge 25. The opening or its insert 22 may have a radius of approximately 5mm, and the recess 23 may have a diameter of approximately 1mm. The ratio between the surface of the suction openings with open and closed cover, respectively, therefore amounts to approximately 25:1.

During manipulation on a processing post, the cover 24 is pivoted to the open position, the yarn 40 to be aspirated is introduced into bore 21, inserted into recess 23, and the cover 24 is closed again.

Figure 6:
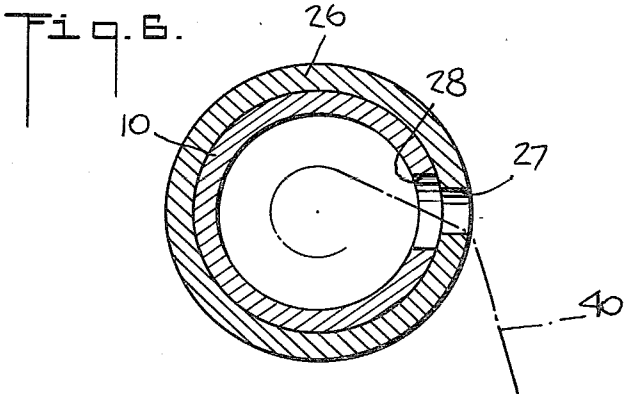
Figure 5:
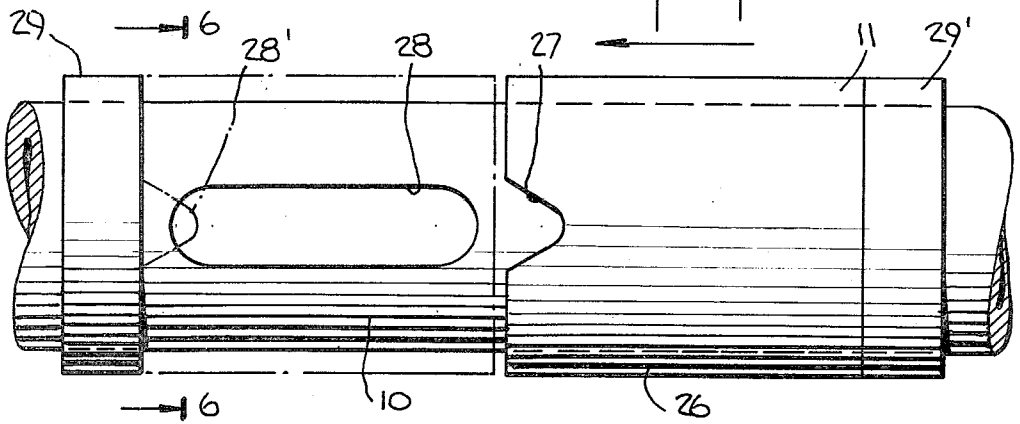

The embodiment of the yarn suction element 11 shown in FIGS. 5 and 6 consists of a tube piece coaxially mounted on tube 10, and which may consist of aluminum with a hard-anodized surface and, at its end, a notch-like recess 27. The tube 10 has a 400mm long and 10mm wide slot-like opening 28 over which tube portion 26 may be shifted until it reaches an abutment 29 so that there remains only the reduced opening 28'. Abutments 29 and 29' positioned on the tube 10 to limit movement of the element 11 consist of sleeves tightly fitting on the tube and fixed on the same in a manner not shown. The ratio between the surfaces of the suction openings with completely open opening 28 and with reduced opening 28' amounts to approximately 80:1.

Figure 7:
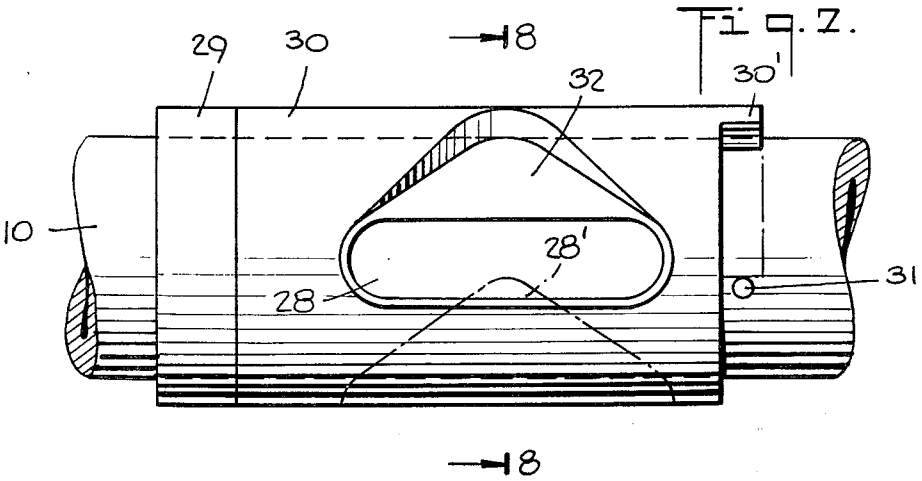
Figure 8:
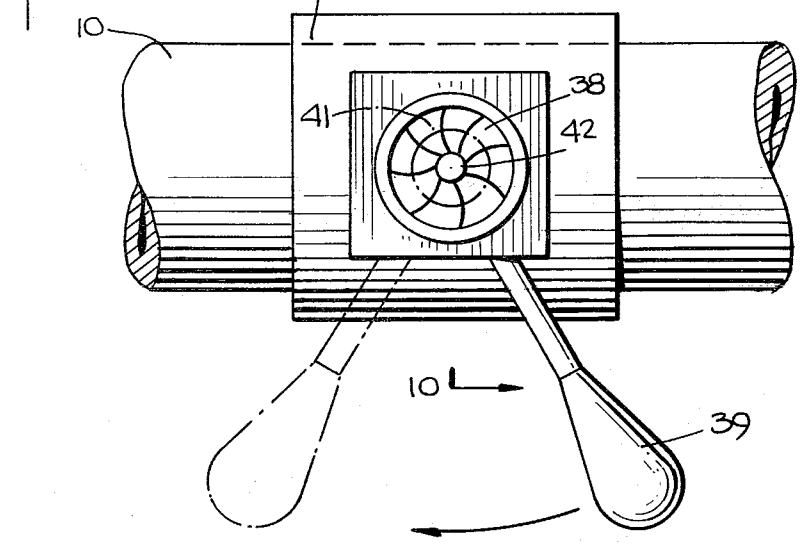

FIGS. 7 and 8 show a similar yarn suction element as that of FIGS. 5 and 6, the tube 10 having again a slot-like opening 28. The tube portion 30 which may also consist of aluminum is provided with a hard-anodized surface and with a central opening 32 and is rotatable on the tube around the tube axis until the protruding marginal portion 30' abuts against pin-shaped stop 31 on tube 10. Also, in this case, the ratio between the surfaces of the suction opening 28 and the essentially reduced opening 28' may amount to approximately 80:1.

Figure 9:
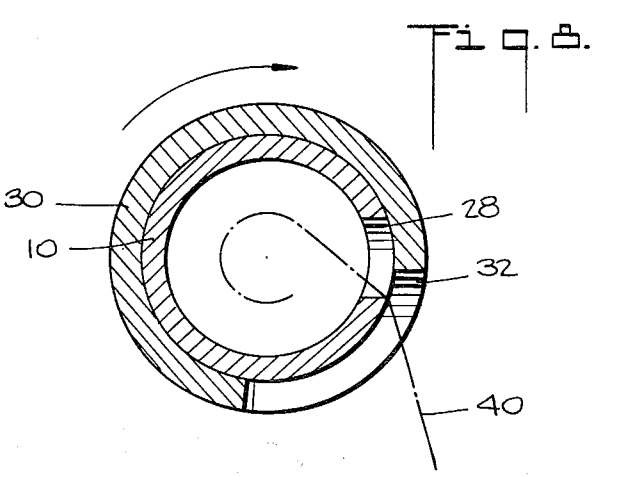
Figure 10:
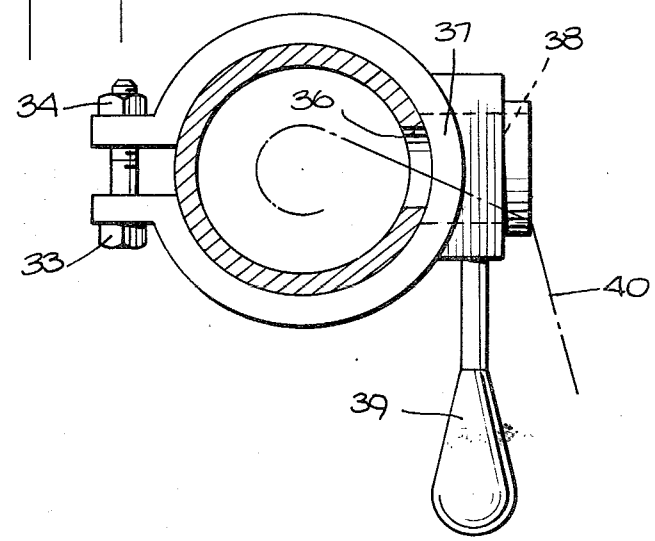

In FIGS. 9 and 10, an embodiment of yarn suction element 11 is shown which consists of a sleeve-shaped support 35, shiftable over tube 10 and fixable thereon by means of screw 33 and screwnut 34, and comprises a bore situated above the circular opening 36 in tube 10 and an iris diaphragm 38 having mutually overlapping segments of wear-resistant material. The diaphragm may be closed and opened by means of lever 39. If the diaphragm is entirely open, its opening 41 has a radius of approximately 5mm, and if the diaphragm is entirely closed, its opening 42 has a radius of approximately 1mm. The ratio between the surfaces of the suction openings with open and closed diaphragm, respectively, therefore amounts to approximately 25:1.

Figures 11, 12, 13, 14:
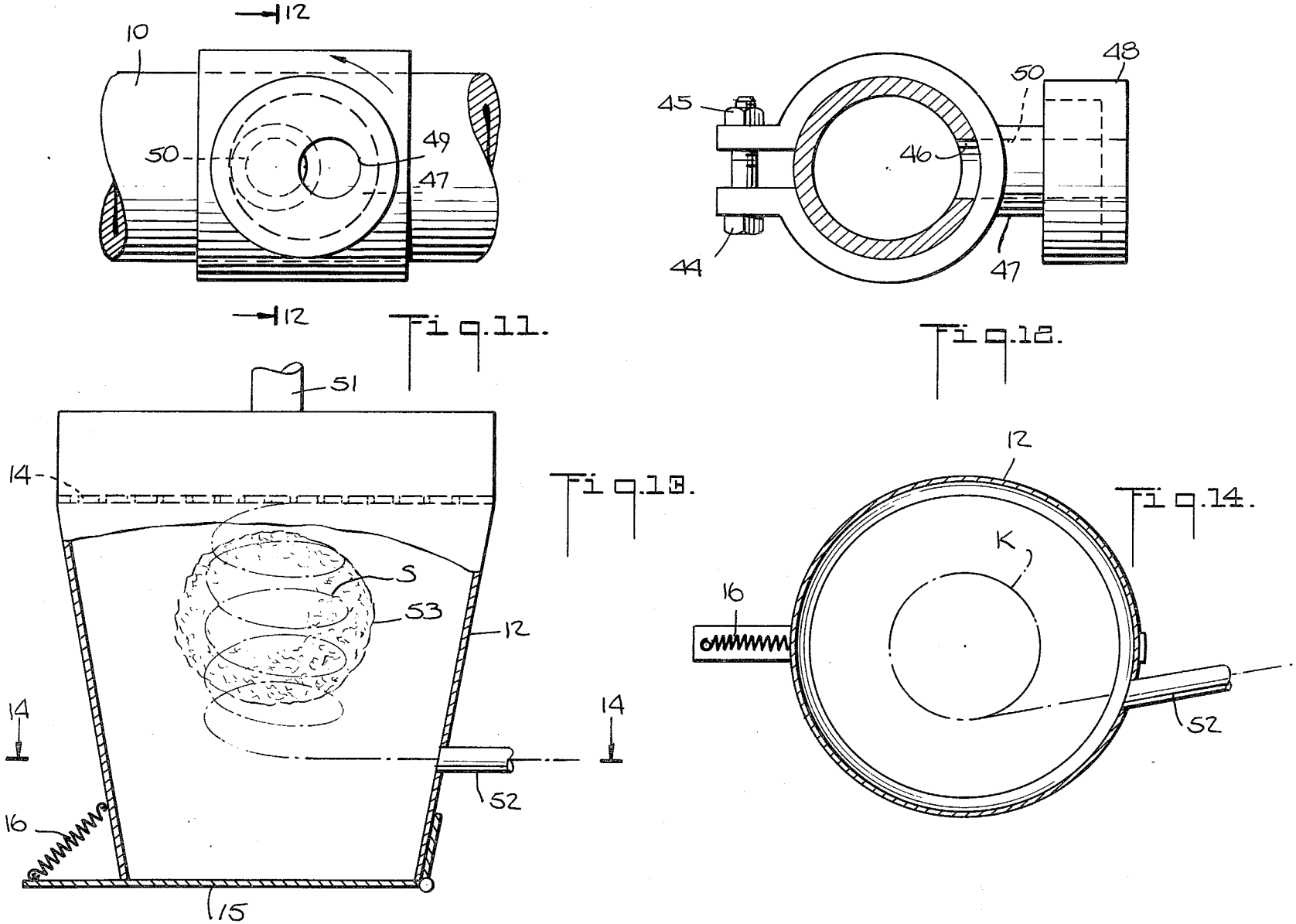
FIG. 13 is a longitudinal sectional view through a container.
FIG. 14 is a cross-sectional view taken along the line 14—14 of FIG. 13.

FIGS. 11 and 12 illustrate a yarn suction element 11 which consists of a sleeve-like support 43, shiftable over tube 10, and which may be fixed on tube 10 outwardly of the circular opening 46 by means of screw 44 and screwnut 45. The support 43 is provided with a cylindrical insert 47 with an eccentric bore 50 which is in line with tube opening 46. On insert 47, we provide a cap-like cover 48 which also comprises an eccentrically arranged circular opening 49. Rotation of cover 48 about its axis permits reduction of the area of the suction opening of bore 50.

The advantages of the auxiliary pneumatic device according to the present invention, consist in that insertion of yarns or bobbin exchange can be effected without difficulty while the machine is in operation. It acts in this case as a third hand which maintains the yarn in place and simultaneously aspirates it so that the ordinary path of the yarn is not disturbed. When introducing the 200 or more yarns of all treating posts of a texturing machine, it is also possible to aspirate all yarns simultaneously by means of the corresponding suction elements without the need of great suction power. The auxiliary device of the present invention may also be used on textile machines having winding posts situated on several levels, only one yarn suction element being necessary for the winding posts situated above each other on the different levels.

As we have stated, the tube terminates in a container for receiving the aspirated yarns, the container being connected with a ventilator switchable on and off as necessary. The container may consist of a block-like enclosure in the upper part of which there is provided a sieve plate as separator.

According to another aspect of the invention, and in order to assure that the aspirated yarn material entering the container will not block the sieve and thus reduce the vacuum, we position between the tube and the vacuum source connected therewith a container of circular cross-section for receiving the aspirated yarns, in the lower part of which we arrange a tube socket entering through the container wall tangentially with respect to the inner circumferential circle of the container or to a circle of smaller diameter concentric therewith, which can be connected with the tube, and in the upper part of which there is arranged a sieve plate serving as a separating member.

The tube socket may preferably extend tangentially with respect to a circle having a radius which corresponds approximately to half the container diameter existing at its entrance location into the container wall.

The arrangement of the tube socket according to the present invention produces, in the container, a spiral-shaped air current by which the aspirated yarns are guided against the sieve plate and eventually form a hank which hovers below the sieve plate and, as its weight increases, successively sinks downwardly. Obturation of the sieve plate and the reduction of suction or vacuum power connected therewith are avoided in this manner.

Referring now to FIGS. 13 and 14, the container 12 is shown as being of conical shape, although a cylindrical container may be used, for receiving the aspirated yarns. In the upper portion of the container, there is provided the sieve plate 14 serving as a separator, and 51 designates the connecting tube leading to the vacuum source (not shown). In the lower part of the container, we provide tube socket 52 which extends tangentially with respect to circle K having a radius equal to half that of the container at that level. The spiral-shaped air current created thereby is indicated by dotted line S. A hank 53 is shown being formed by the aspirated yarns, which hank hovers below the sieve plate 14. The tube socket 52 can be connected with the suction tube (not shown) by means of a connection tube which may be flexible if necessary. On the lower side, the container 12 is provided with a cover 15 for emptying same, as stated earlier.

We believe that the construction and operation of our novel auxiliary pneumatic device will now be understood and that the advantages thereof will be fully understood by those persons skilled in the art.

We claim:

1. Auxiliary pneumatic device for aspirating a running yarn during manipulations on a textile machine having a plurality of yarn treatment posts, at least one tube extending along the machine length, a vacuum source connected with said tube so that air is led through the tube towards the vacuum source, the tube being provided at regular distances with openings, and suction elements each consisting of a body tightly fitting the tube, each said body being slidable relatively to the tube and fixable in a predetermined position relative to a respective tube opening to control the size of said opening within a range from full open to a predetermined minimum opening, each said slidable body comprising a bore extending radially with respect to the tube and which is positionable in line with the respective tube opening.

2. Device according to claim 1, characterized by a tubular insert (22) of wear-resistant material, tightly fixed in the bore, and comprising a recess (23) in its rim (22') and a cover (24) positionable for closing the bore (21).

3. Device according to claim 1, characterized by an iris diaphragm (38) with mutually overlapping segments of wear-resistant material positioned in registry with said bore, and means for controlling the size of the diaphragm opening.

Device according to claim 1, characterized by a container (12) of circular cross-section positioned between said tube (1) and said vacuum source, a tube socket (52) entering through a lower portion of the container wall in a tangential direction with respect to an imaginary inner circule of the container concentric therewith and which has a smaller radius than said container to produce a spiral shaped air current, the tube socket being connected with the tube (10), and a sieve plate (14) arranged in the upper part of said container as a separation element.

5. Device according to claim 4, characterized in that the container (12) is of conical shape.

6. Device according to claim 4, characterized in that the container (12) is of cylindrical shape.

7. Device according to claim 4, characterized in that the tube socket (52) extends tangentially with respect to a circle having a radius which corresponds approximately to half the radius of the container at the level at which the tube socket enters the container.

8. Auxiliary pneumatic device for aspirating a running yarn during manipulations on a textile machine having a plurality of yarn treatment posts, at least one tube extending along the machine length, a vacuum source connected with said tube so that air is led through the tube towards the vacuum source, the tube being provided at each treatment post with one slot-like opening and one coaxial tube portion tightly fitting the tube, each said tube portion being provided with a central opening and being slidable on the tube about the tube axis to partially close its respective opening, and an abutment being provided on said tube to limit the movement of each said tube portion.

9. Device according to claim 8, characterized in that the coaxial tube portion (26, 30) consists of aluminum or of an aluminum alloy and has a hard-anodized surface.

10. Device according to claim 8, characterized in that the coaxial tube piece (26) comprises at one end a notch-like recess (27) and abutment means (29,29') positioned on the tube to limit movement of said tube portion.

11. Device according to claim 8, characterized by a container (12) of circular cross-section positioned between said tube (10) and said vacuum source, a tube socket (52) entering through a lower portion of the container wall in a tangential direction with respect to an imaginary inner circle of the container concentric therewith and which has a smaller radius that said container to produce a spiral shaped air current, the tube socket being connected with the tube (10), and a sieve plate (14) arranged in the upper part of said container as a separation element.

12. Device according to claim 11, characterized in that the container (12) is of conical shape.

13. Device according to claim 11, characterized in that the container (12) is of cylindrical shape.

14. Device according to claim 11, characterized in that the tube socket (52) extends tangentially with respect to a circle having a radius which corresponds approximately to half the radius of the container at the level at which the tube socket enters the container.

15. Auxiliary pneumatic device for aspirating a running yarn during manipulations on a textile machine having a plurality of yarn treatment posts, at least one tube extending along the machine length, a vacuum source connected with said tube so that air is led through the tube towards the vacuum source, the tube being provided at regular distances with openings, and suction elements each consisting of a body tightly fitting the tube, each said body being slidable relatively to the tube and fixable in a predetermined position relative to a respective tube opening to control the size of said opening within a range from full open to a predetermined minimum opening, each said slidable body being provided with a cylindrical part the axis of which extends radially with respect to the tube, said cylindrical part having a bore the axis of which extends parallel to the cylinder axis and on the cylindrical part of which there is provided a cap-like cover with a circular opening, said opening being eccentrically arranged with respect to the center of said cover.

16. Auxiliary pneumatic device for aspirating a running yarn during manipulations on a textile machine having a plurality of yarn treatment posts, at least one tube extending along the machine length, a vacuum source connected with said tube so that air is led through the tube towards the vacuum source, the tube being provided at each treatment post with one slot-like opening and one coaxial tube portion tightly fitting the tube, each said tube portion consisting of aluminum or of an aluminum alloy with a hardanodized surface and comprising at one end a notch-like recess, and abutment means positioned on the tube to limit the movement of each said tube portion between positions wherein the respective tube opening is full open and wherein there remains a reduced opening formed by said opening and said notch-like recess.

* * * * *